United States Patent [19]

Adimari et al.

[11] Patent Number: 4,989,517

[45] Date of Patent: Feb. 5, 1991

[54] TANDEM BOMBLET

[75] Inventors: Louis J. Adimari, Montague; Jerry Pentel, Montville, both of N.J.

[73] Assignee: The United States of America as represented by the Secretary of the Army, Washington, D.C.

[21] Appl. No.: 376,431

[22] Filed: Mar. 29, 1982

[51] Int. Cl.[5] ..... F42B 10/32; F42B 12/16

[52] U.S. Cl. ..... 102/388; 102/393; 102/476; 102/489

[58] Field of Search ..... 102/382, 384–386, 102/388, 389, 394, 396, 397, 475, 476, 489

[56] References Cited

U.S. PATENT DOCUMENTS

| | | | |
|---|---|---|---|
| 1,318,926 | 10/1919 | Settle | 102/388 |
| 2,804,823 | 9/1957 | Jablansky | 102/476 |
| 3,173,365 | 3/1965 | Battaglini | 102/397 |
| 3,306,199 | 2/1967 | Karin et al. | 102/388 |
| 3,750,582 | 8/1973 | Kintish et al. | 102/476 |
| 3,838,644 | 10/1974 | Prochnow et al. | 102/476 |
| 4,181,079 | 1/1980 | Klier et al. | 102/476 |

*Primary Examiner*—David H. Brown

*Attorney, Agent, or Firm*—Robert P. Gibson; Edward Goldberg; Michael C. Sachs

[57] ABSTRACT

The invention discloses an improved conventional munition employing a dual bomblet configuration including dual shaped charges and a design which uses a Misznay-Schardin end plate with a shaped charge. Both bomblets are separately enclosed by fragmenting warheads that are positioned in tandem. the tandem bomblet design results in a nesting arrangement of the fragmenting warhead, or sub-munition, to produce maximum packaging efficiency. A forward sub-munition of a tandem bomblet will nest within a cavity of a shaped charge of an aft sub-munition.

3 Claims, 5 Drawing Sheets

TANDEM BOMBLET

GOVERNMENTAL INTEREST

The invention described herein may be manufactured, used and licensed by or for the Government for governmental purposes without the payment to us of any royalties thereon.

BACKGROUND OF THE INVENTION

Various means have been used in the prior art to attack and defeat armor. In the past, where multiple targets were desired to be defeated which were spread over a relatively wide area, a rocket or artillery warhead was used. These munitions frequently contained deployable submunitions. A problem with conventional prior art devices was in their inability to defeat newly developed armor which utilized certain combinations of materials. Such new combinations of armor were effective to stop munitions containing shaped-charges or munitions containing kinetic energy penetration in the form of heavy metal rods or those which used self-forging fragments. The increases in the size of the warhead charge in the submunitions was only partially effective against such new armor. The increase in size of the warhead reduced the number of submunitions that could be packed into a projectile and thereby limited the number of targets which could be attacked and thus decreased hit probability. Application of the use of higher energy explosives, while slightly improving the penetrability of the target, still failed to defeat the armored target and also significantly increased the cost of the munition.

This invention is concerned with ordnance of the type denominated improved conventional munitions. The advantages of improved conventional munitions are many: one particular advantage thereof is as a countermeasure to enemy usage of modern armored vehicles.

PRIOR ART STATEMENT

The prior art, as it is best known to the inventors, is reflected in U.S. Pat. No. 3,750,582.

The present invention may be distinguished from the aforementioned patent by the existence of a fixed spacing between the tandem-shaped charges. In distinction the present invention differs from the prior art in having separate positions for the tandem shaped charges during the packaging stage and during the deployment stage.

SUMMARY OF THE INVENTION

The tandem bomblet design is an innovative application of conventional munitions which makes use of existing technology in charges as well as in self-forging fragment principles known in the design of kill-mechanism devices.

A design of the present invention is that of a dual bomlet employing a shaped charge and a so-called Misznay-Schardin end plate separately enclosed by fragmenting warheads in tandem.

In an alternate embodiment, when stacked for application in projectile warheads, the tandem bomblet results in a nesting arrangement of fragmenting warheads, or of sub-missiles which produce a maximum packaging efficiency, i.e., a forward bomblet or submissile will nest within a cavity of an aft bomblet or submissile. For this purpose, it is desirable that the entire fuze section of the forward bomblet, located at the top of the forward sub-munition, be nested or housed within the bottom cavity of the aft sub-munition.

As will be seen, the instant invention employs a multitude of independently fuzed sets of bomblets or submunitions which are situated within a dispensing means, such as a rocket, artillery projectile, or aircraft dispenser. These devices are divided into subsets, each subset consisting of at least two bomblets, e.g., an aft bomblet and a forward bomblet. After ejection from the dispensing means, the bomblets of each set will increase their relative distance to the extent allowed by the length of a connector means.

DESCRIPTION OF THE PREFERRED EMBODIMENT

Figure 1:
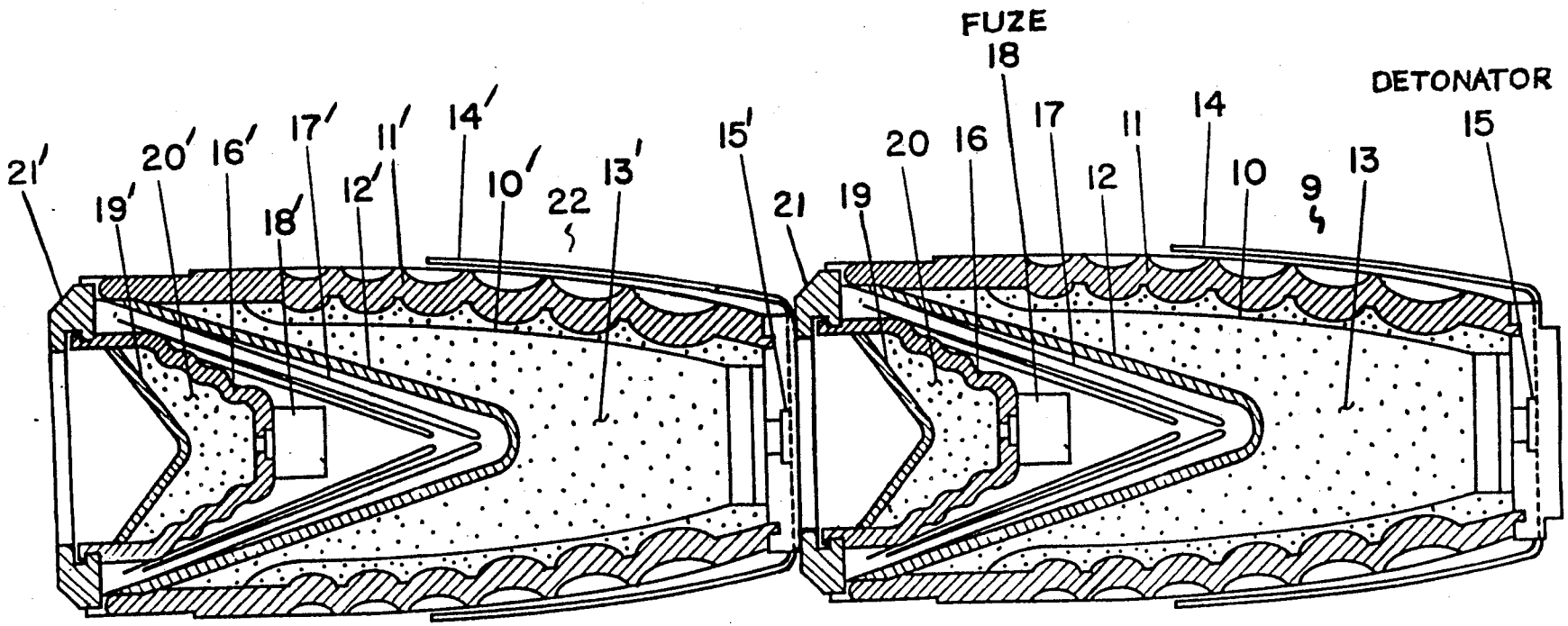
FIG. 1 shows the tandem bomblets in a stacked configuration.

There is illustrated in FIG. 1 an assembly 9, wherein tandem bomblets are disposed in a stacked configuration. An aft (second in position) bomblet 10 having a fragmenting body 11 and a shaped charge liner 12 serve as an antimateriel kill mechanism. An explosive shaped charge 13, stabilization fins 14 and an electric detonator 15 comprise the main parts of the aft bomblet 10.

A forward (first in position) bomblet 16 is smaller than the aft bomblet 10. The forward bomblet 16 is stacked inside the shaped-charge liner 12 and is connected to the aft bomblet 10 by connector-separator means 17 such as strip metal tabs or springs which means also serve as electrical leads for electrically initiating detonator 15. The forward bomblet 16 also includes a fuze 18, a forward bomblet shaped-charge liner 19 and a forward bomblet explosive shaped-charge 20.

For assembly purposes, and to withstand loads to which the bomblets are subjected during launch, a split-holding plate 21 is provided. This plate also facilitates the assembly of the next tandem bomblet 22. The tandem bomblet 22 is alike assembly 9; like parts are marked in 22 with a prime number designation, in most cases, to familiarize the reader with their counterparts in forward assembly 9. The tandem assembly of bomblet devices, each device comprising aft and forward tandem submunitions of its own, illustrates one of the compact features of this invention which had been mentioned earlier.

Figure 3:
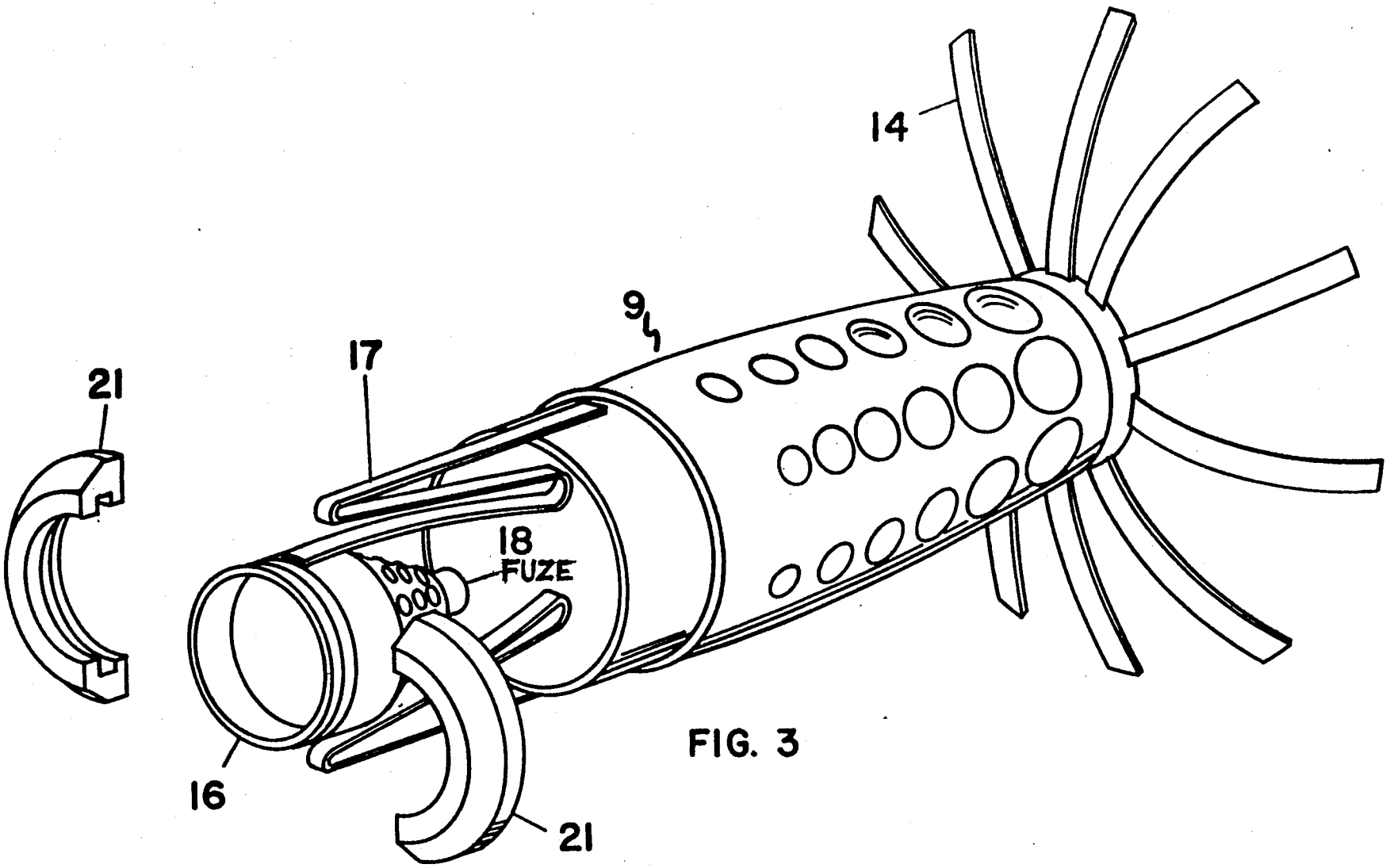
FIG. 3 shows the flight bomblet separation when the holding plate releases the forward bomblet.

There is illustrated in FIG. 3 the flight bomblet separation which occurs when the split-holding plate 21 releases the forward bomblet 16. During separation, the connector separator 17 begins to unfold and the fins 14 are deployed.

Figure 4:
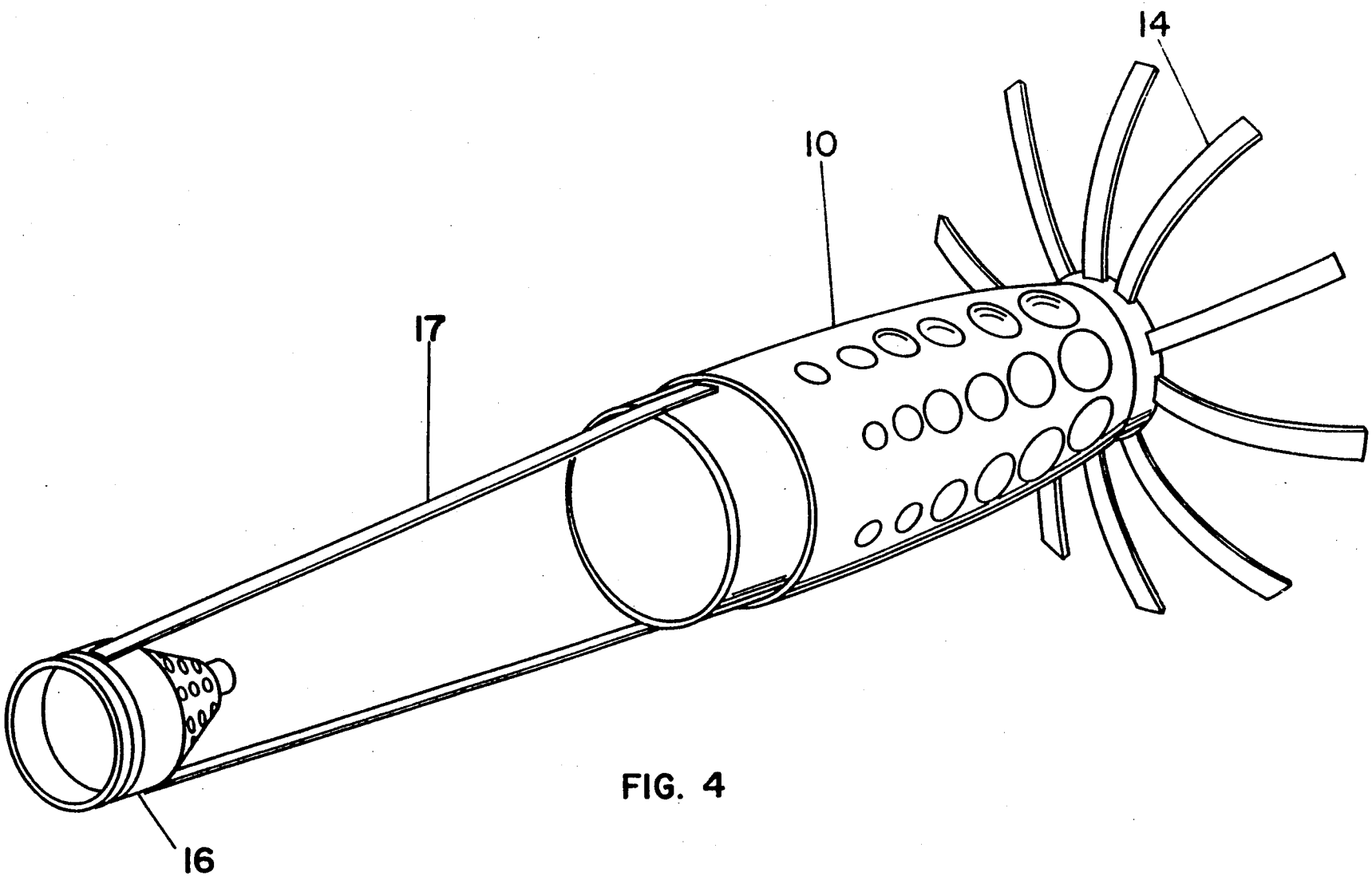
FIG. 4 shows a fully deployed tandem bomblet.

Referring now to FIGS. 1 and 4, there is shown a fully deployed tandem bomblet. It is seen that when the forward bomblet 16 impacts upon a target, the impact fuze 18 will initiate the explosive charge 20. Also, the fuze 18 will create an electric charge, causing an electric current to flow to the detonator 15 through the metal casing of the forward bomblet 16, the metal connector 17, and the metal casing of the aft bomblet 10. Further, the detonator 15 will initiate the explosive charge 13 of the aft bomblet 10. In this arrangement of functional parts, the aft bomblet does not require a fuze for proper initiation.

In view of the above, it is seen and appreciated that FIGS. 1 through 4 describe an integral bomblet configuration wherein the forward bomblet 16 is packaged inside the aft (or second bomblet 10.

Figure 5:
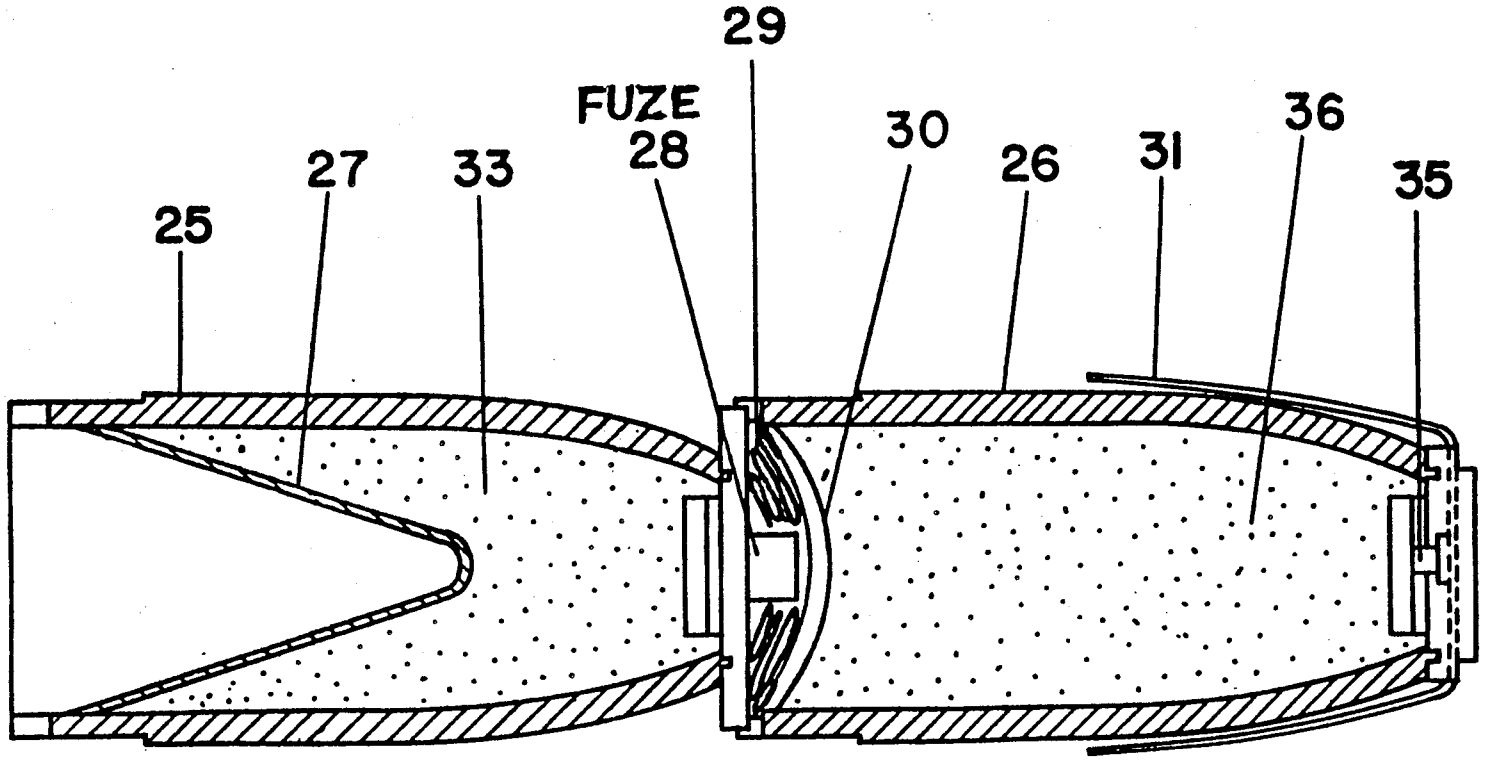
FIG. 5 shows a second embodiment of the present invention.
Figure 2:
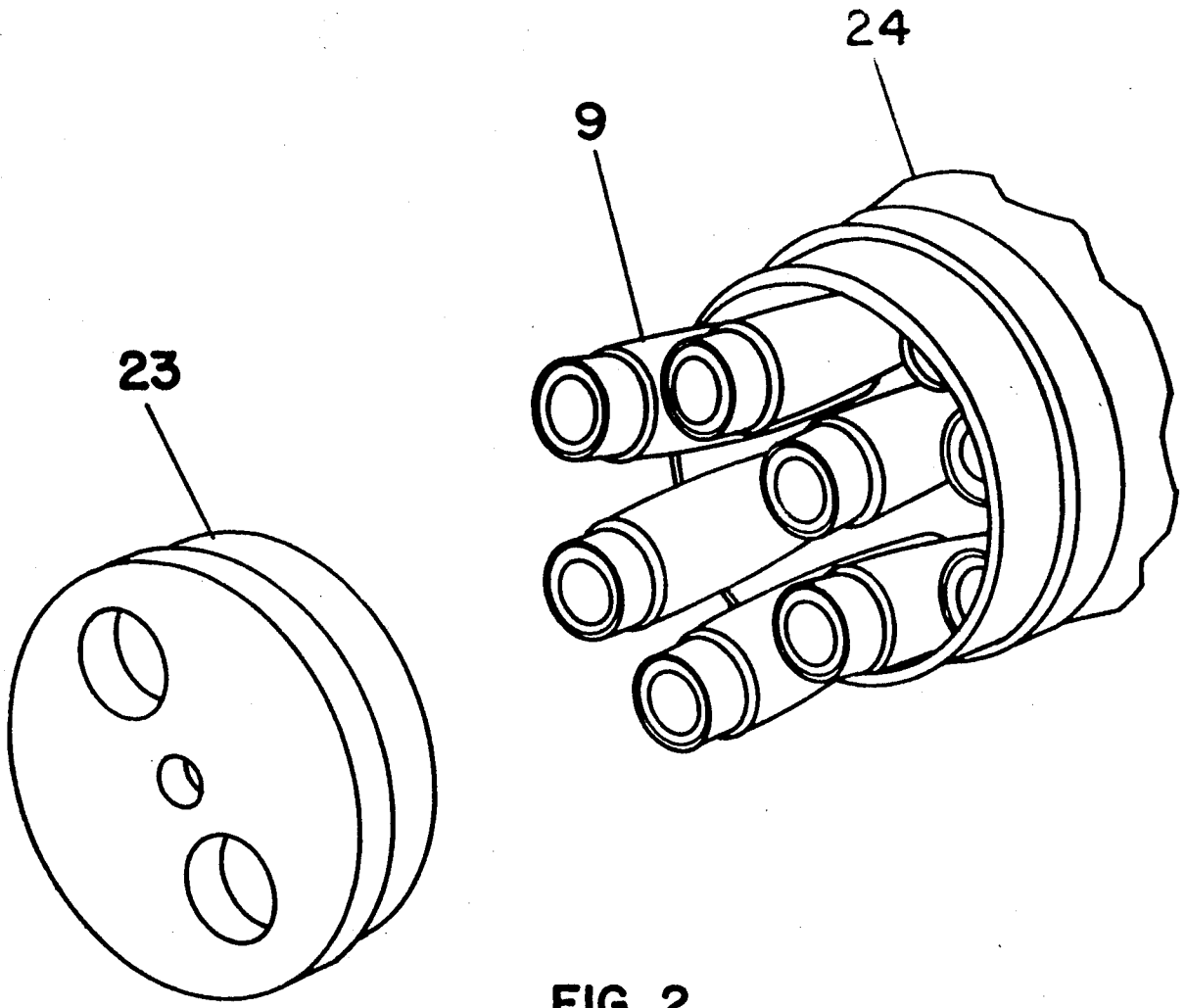
FIG. 2 shows the sub-munition dispensing event when the base plate is separated from the carrier projectile.

A second embodiment of the present invention is illustrated in FIG. 5. In this embodiment, there is depicted a "back-to-front" design in which a forward bomblet 25 is stacked against the front of an aft bomblet 26. Therein, the forward bomblet 25 employs a shaped-charge 27 as a kill mechanism and is equipped with an impact fuze 28. Electrical and mechanical-connector means 29 connect the two bomblets 25 and 26. A self-forging fragment element 30 comprises a kill mechanism of the aft bomblet 26; however, a shaped-charge can also be used. A stabilization-fin assembly 31 provides for proper separation and orientation of the bomblets after ejecting from the carrier.

In both embodiments, it is understood that the tandem bomblets remain stacked or nested within the projectile carrier 24, having a hypothetical end cover 23 until a specified point along the projectile trajectory where they are expelled from the carrier 24 for deployment against a ground station target. Upon expulsion from the carrier, each sub-munition assembly will assume its own trajectory in flight. Under the action of spin and drag forces, the folded spring-loaded vane stabilizers 14 of FIGS. 1, 3 and 4, and stabilizers 31 of FIG. 5, will deploy to separate the forward and aft sub-munitions to a fixed relative distance, as the same is measured by the length of the steel connectors or couplings. This length being approximately one bomblet unit in length. The fuze-arming function of the forward sub-munition 16 and 25 can be accomplished along the trajectory with either a mechanical rotary fuze or with a mechanical drag device such as a ribbon under the action of drag forces, as is well known in the art. Upon impact with the ground target, the forward bomblet is initiated by inertial impact forces.

In the FIG. 5 embodiment, the fuze action will not only detonate the main explosive shaped charge 33 creating a shaped-charge jet effect but will also serve to initiate the electric detonator 35 via connector 29 and body of the aft sub-munition 26. Detonator 35 will in turn initiate the explosive charge 36 of the aft sub-munition to produce a follow-on kinetic energy penetrator from the configured self-forging fragment 30, that is, an inverted plate. The pentrator will pass directly in line through the hole created in the target by the forward sub-munition. It should be noted that although only two sub-munitions in tandem are illustrated. embodiments for more than this number may be assembled for special targets.

While there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

We claim:

1. An improved conventional munition, comprising:

(a) a multiplicity of independently fuzed tandem bomblets in a stacked configuration, said tandem bomblets comprising at least an aft bomblet and a forward bomblet, each subset of bomblets including only one fuze, said fuze operatively disposed in said forward bomblet, bomblets subsequent to the first bomblet including a detonation means electrically connected to said fuze to initiate an explosive charge in subsequent bomblets, said tandem bomblets comprising a self-forging fragment plate in each said aft bomblet, each bomblet comprising an anti-materiel kill means and anti-personnel kill means, said first and second bomblets being stacked in abutment with each other and connected by integral mechanical and electrical connecting means;

(b) launch and dispensing means within which the bomblets are carried; and (c) fin means for stabilizing said tandem bomblets in flight to set the target and for separating said bomblets from one another to a fixed optimal stand-off distance when expelled from said dispensing means.

2. The improved conventional munition as recited in claim 1 further comprising connecting means for setting the distance between said bomblets to enable the formation of a slug, from the self-forging fragment plate, prior to impact.

3. The improved munition as recited in claim 2 in which said connecting means includes a metal strip length which permits each said aft bomblet to detonate prior to impact to increase the anti-personnel lethality.

* * * * *